United States Patent [19]

Samuelsson

[11] Patent Number: 4,522,110

[45] Date of Patent: Jun. 11, 1985

[54] HYDRAULIC RADIAL PISTON MOTOR

[75] Inventor: Einar Samuelsson, Örnsköldsvik, Sweden

[73] Assignee: AB Hägglund & Söner, Mellansel, Sweden

[21] Appl. No.: 529,647

[22] Filed: Sep. 6, 1983

[30] Foreign Application Priority Data

Sep. 8, 1982 [SE] Sweden ..... 8205097

[51] Int. Cl.[3] ..... F01B 13/06; F01B 31/00

[52] U.S. Cl. ..... 91/488; 91/491

[58] Field of Search ..... 91/488, 487, 491, 492, 91/498

[56] References Cited

U.S. PATENT DOCUMENTS

| | | | |
|---|---|---|---|
| 2,638,850 | 5/1953 | Ferris | 91/488 |
| 2,980,077 | 4/1961 | Magill | 91/488 |
| 3,165,068 | 1/1965 | Bornham et al. | 91/488 |
| 3,699,848 | 10/1972 | Prendergast | 91/498 |
| 3,789,741 | 2/1974 | Hallberg | 91/488 |
| 3,913,455 | 10/1975 | Green et al. | 91/492 |
| 4,144,798 | 3/1979 | Cyphelly | 91/488 |
| 4,144,799 | 3/1979 | Ponchaux | 91/488 |
| 4,326,450 | 4/1982 | Bacquie | 91/487 |

FOREIGN PATENT DOCUMENTS

| | | | |
|---|---|---|---|
| 906766 | 2/1954 | Fed. Rep. of Germany | 91/488 |
| 2335976 | 1/1975 | Fed. Rep. of Germany | 91/491 |
| 1347220 | 11/1963 | France | 91/492 |
| 175914 | 3/1922 | United Kingdom | 91/498 |
| 2086991 | 5/1982 | United Kingdom | 91/491 |
| 258857 | 4/1970 | U.S.S.R. | 91/488 |

*Primary Examiner*—William L. Freeh

*Attorney, Agent, or Firm*—Watson, Cole, Grindle & Watson

[57] ABSTRACT

A hydraulic radial piston motor with a cam disc and a cylinder block with a number of pistons running in cylinders in the block presses rollers against the cam disc in such a way that a torsional moment arises. The rollers are formed with guide members running in slots in guide units which take up tangential forces. The rollers are mounted in roller cages which are formed with hydrostatic bearings. At their outer end each piston is formed with a part-spherical bearing surface and the roller cage has a cooperating part-spherical bearing surface, which allows angular movements between the roller cages and the pistons in all directions.

18 Claims, 7 Drawing Figures

HYDRAULIC RADIAL PISTON MOTOR

TECHNICAL FIELD

The invention relates to a hydraulic radial piston motor with a number of drive rollers running along an internal cam surface in a motor housing and being urged radially outwardly towards the cam surface by a number of pistons slidably disposed in cylinders in a cylinder block arranged in the motor housing. In one embodiment of such a radial piston motor for heavy duty applications, the pistons are completely relieved of tangential forces by the fact that pins projecting from the drive rollers towards the cylinder block are provided with bearings which run in radially disposed slots in guide units which are fixedly joined to the cylinder block on opposite sides thereof. Either the housing of such a motor may be stationary and the cylinder block rotates, or the cylinder block may be stationary and the housing rotates. In the first embodiment the motor is usually intended to be connected to a driven shaft. In the second embodiment it is usually intended to be connected to a wheel or a cable drum for a winch or the like.

DISCUSSION OF PRIOR ART

In hitherto known embodiments of radial piston motors of the above-mentioned kind, the piston force has been transmitted to each cam-follower roller via a piston rod which is similar in design to a conventional connecting rod. The roller has heretofore been journalled at its mid-point in a bearing at the outer end of the piston rod and formed with roller ways on either side of the bearing. At its radially inner end, the piston rod has been journalled in the piston. The journalling of the roller means that the length of the roller increases with the width of the bearing in the rod. The width of the roller way in the motor housing becomes wider by a corresponding measure, and its mid-portion is therefore not fully utilized.

OBJECTS OF THE INVENTION

One object of the invention is to provide a very compact hydraulic radial piston motor having reduced radial and axial dimensions.

Another object of the invention is to utilize the width of the entire cam surface in a motor of this kind as an efficient roller way.

A third object is to transmit the force to the drive roller via the pressure medium, by causing the medium to act directly on the drive roller and thus reduce the stresses on the bearings which support the drive roller, thus making possible transmission of greater forces and/or of achieving a considerably increased life of wear parts.

An additional object of the invention is to design roller cages and pistons in such a way that irregularities in shape and deformations of the components of the motor will not give rise to harmful stresses in or between the pistons and cages for the drive rollers and between such roller cages and the roller contained therein.

BRIEF SUMMARY OF THE INVENTION

According to the invention, the pistons running in the cylinders in the cylinder block are formed on a radially outer portion with a part-spherical bearing surface. The drive rollers running against the cam surface are journalled in roller cages with a cylindrical bearing seat which is constructed as a hydrostatic bearing and with a part-spherical bearing surface which cooperates with the part-spherical bearing surface of the piston. The roller cage is thus able to tilt in all directions around the center of the spherical bearing. Since the roller cage can tilt in this way relative to the piston, the piston is protected from overturning moments caused by movements of the roller cage due to imperfections of the cam curve and guides for the rollers.

The pistons of the motor are formed with a through-going axial bore which suitably has a greater diameter in its radially outer part than in its radially inner one. The roller cages which support the drive rollers are formed with a guide pin which extends down into the outer part of the through-going piston bore having a greater diameter than the radially inner parts thereof. To prevent the roller cages and the pistons from being separated during operation of the motor, the roller cages and the pistons may be held together by a strong spring which can be attached within the guide pin and to the radially inner part of the piston. The roller cage may be formed so that it surrounds the drive roller over more than 180°, the roller thereby being fixed in its cage. The cage may also be formed with a surrounding angle smaller than 180°, whereby the roller cage or the motor is provided with other means for fixing a roller in the roller cage or for guiding the roller. The cylindrical bearing seat for the roller is formed with a defined hydrostatic supporting surface so as to obtain a suitable balancing of the force against the roller. The supporting surface may be defined by grooves which provide gap sealing. The radial compressive forces, acting on the roller cage and on the piston, are suitably outbalanced hydrostatically to more than 80%, preferably to between 80 and 95%.

BRIEF DESCRIPTION OF DRAWINGS

The invention will now be further described, by way of example, with reference to the accompanying drawings, in which.

DESCRIPTION OF PRIOR ART MOTOR

Figure 1:
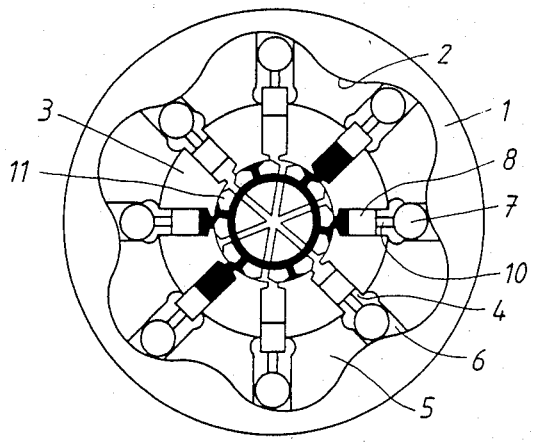
FIG. 1 shows schematically, in radial section, a hydraulic radial piston motor of the type to which the invention refers but of a prior art design.

FIG. 1 shows a prior art hydraulic radial piston motor in which the numeral 1 designates a cam disc with an internal cam surface 2. This cam disc 1 is arranged in a rotatable housing (not shown) capable of driving a wheel or a winch. A cylinder block 3 with a number of cylinders 4 is stationarily arranged within the cam disc 1. On either side of the cylinder block 3 there are guide units 5 formed as discs providing slots 6 for guiding cam-follower rollers 7 and taking up the tangential forces which occur when the rollers 7 are pressed against the cam surface 2. The guide units 5 are fixedly joined to the cylinder block 3 and thus are also stationary. A piston 8 is slidably disposed in each cylinder 4 in the block 3. The pistons 8 are joined to their respective cam-follower roller 7 by rods 10 designed as connecting rods. The roller assemblies consist of a cross head shaft on which two cam-follower roller bearings and two guide roller bearings are placed. The connecting rod is shrunk on to the cross head shaft. Within the cylinder block 3 is located a rotatable slide 11 for the correct timed distribution of a suitable pressure medium to the cylinders 4. Conduits and cylinders with pressure medium with high pressure are drawn in FIG. 1 filled in in black while the unpressurized ones are not filled in.

DESCRIPTION OF PREFERRED EMBODIMENT OF INVENTION

Figure 2:
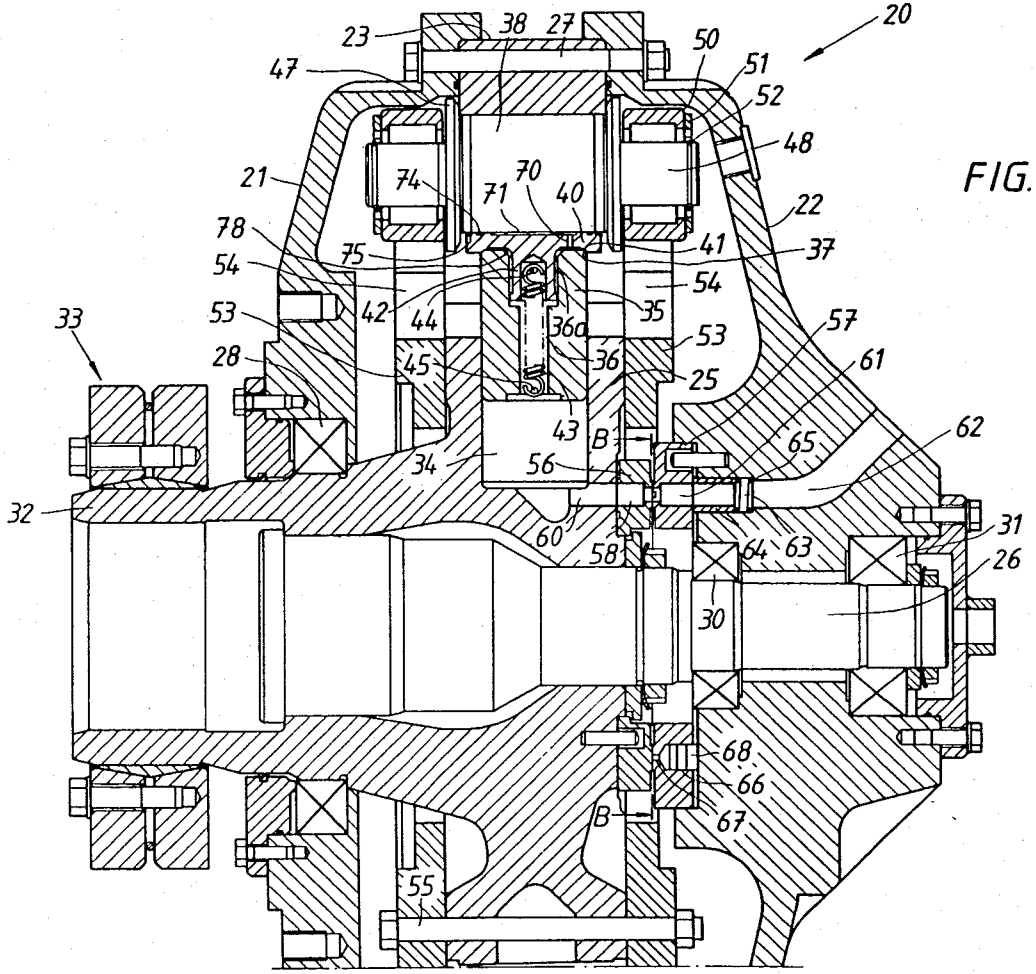
FIG. 2 shows an axial section through a motor according to the invention.
Figure 3:
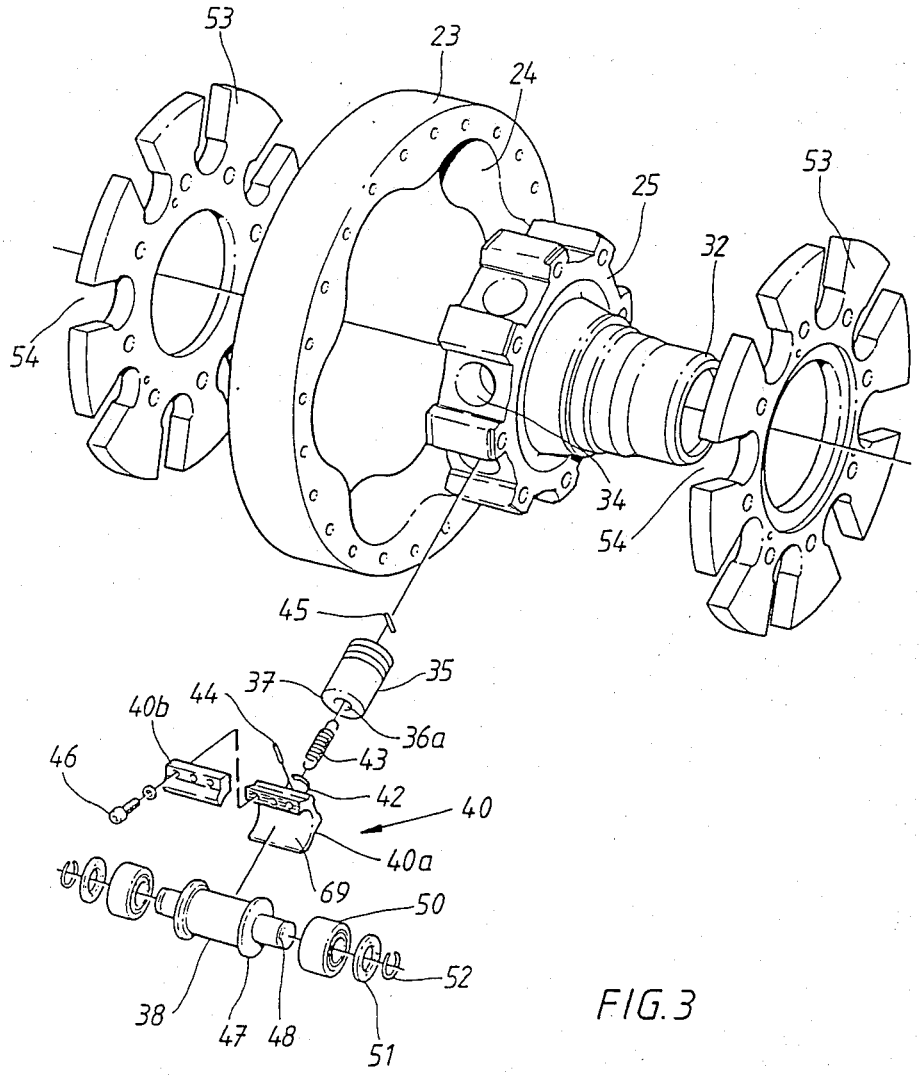
FIG. 3 shows an exploded view embodying the essential working parts of the motor of FIG. 2.

In FIG. 2, the numeral 20 designates a motor housing in a hydraulic motor according to the invention and of a type having a stationary motor housing. It comprises two end covers 21 and 22 and a cam disc 23, arranged therebetween, with an internal cam surface 24. The end covers 21 and 22 and the cam disc 23 are held together by bolts 27. A cylinder block 25 with a shaft 26 is rotatably journalled in the end covers 21 and 22 of the motor housing 20 in bearings 28, 30 and 31. The portion 32 of the motor block is intended to be connected to a shaft (not shown) by a cone coupling 33.

In the cylinder block 25 there are a number of radially oriented cylinders 34, in which pistons 35 are slidably disposed. These pistons are formed with a through-going bore 36, the outer portion 36*a* of which has a larger diameter than the rest of the bore 36. At their outer ends, the pistons are formed with a part-spherical bearing seat 37. Drive rollers 38 run against the cam surface 24. The drive rollers 38 are journalled in roller cages 40, which are formed with hydrostatic bearings. Further, these roller cages 40 are formed with a part-spherical bearing seat 41 adapted to fit on the bearing seat 37 of the pistons 35. Thus, the roller cages 40 are able to tilt in all directions in relation to the pistons 35. The pistons are subjected neither to over-turning moments, nor to lateral forces, due to the fact that the roller cages are slidably movable on the rollers. Each roller cage 40 is formed with a guide tube 42 extending down into the respective bore 36*a*. This guide tube 42, at least over a part of its length, is given such a diameter that between this part and the surrounding bore 36*a* of the piston 35 a throttling annular slot is formed. This slot restricts the loss of pressure fluid in the case that the roller cage is separated from the piston. Further, by this throttling effect the loss of the driving force outwardly is limited as the fluid pressure acting upon the area of the guide tube only drops insignificantly. Further, the pressure drop in the space between the roller cage 40 and the outer end of the piston 35, when the roller cage 40 and the piston 35 are separated, causes forces which tend to bring the roller cage 40 and the piston 35 together again. Under normal conditions with a small pressure medium flow for replacing pressure medium lost between the bearing surfaces, the pressure drop over the slot is negligible. The radial size of the slot is limited to an amount determined by the necessary free movement between the roller cage 40 and the piston 35. With a guide tube diameter of 30 mm, the suitable minimum radial size of the slot is on the order of 0.3 mm. Each piston 35 and its roller cage 40 are retained together by a spring 43 which is attached in the guide tube 42 and on the piston 35, respectively, by pins 44 and 45. Each roller cage 40 surrounds its roller 38 over more than 180°, whereby each roller 38 will be radially fixed in its cage 40. Because this surrounding angle is greater than 180°, each cage 40 consists of two parts 40*a* and 40*b* which are retained together by bolts 46.

Each roller 38 is formed with flanges 47 for holding the roller axially on the cam disc 23. Further, each roller is provided with a pin 48 supporting a pair of roller bearings 50, the outer ring of each of which forms a guide roller. The bearings 50 are fixed on the respective pins 48 by washers 51 and lock rings 52. Two disc-shaped guide units 53 with radially oriented slots 54 are fixedly joined to the cylinder block 25 by bolts 55. By means of the guide rollers 50, tangential forces acting on the drive rollers 38 are transmitted via the guide units 53 to the cylinder block 25.

Pressure medium is led to and from chosen ones of the cylinders 34 in the cylinder block 25 via a slide valve having two slide rings 56 and 57. The ring 56 is connected to the cylinder block 25 in such a way that it rotates with the block. The ring 57 is connected to the end cover 22 in such a way that it is stationary but axially displaceable towards the ring 56. The ring 56 is provided with through-going passages 58 aligned with channels 60 in the cylinder block 25 which extend into respective ones of the cylinders 34. The ring 57 is provided with through-going passages 61 which are aligned with channels 62 in the end cover 22 for the supply and discharge, respectively, of pressure medium. At the inner end of each channel 62, there is a bore 63 in which there is mounted a sleeve 64 which is pressed against the slide ring 57 by a spring 65 and by the pressure medium acting on the inner end surface of the sleeve. In the slide ring 57 there are bores 66 having a restricted opening 67 in the side facing the ring 56. Pistons 68 are slidably mounted in the bores 66 and rest against the end cover 22. The purpose of these pistons is to bring about equalization of forces which arise when changing between supply and drainage of pressure medium to and from the cylinders 34, respectively.

Figure 4:
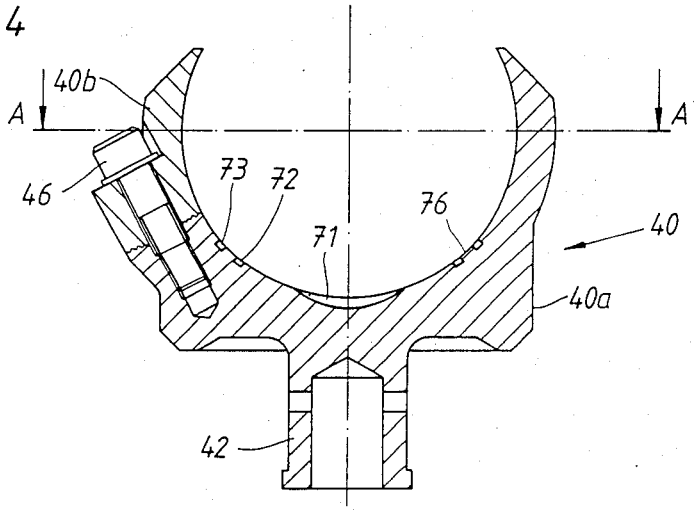
FIG. 4 shows a section through a roller cage of the motor of FIG. 2 perpendicular to the bearing shaft.
Figure 5:
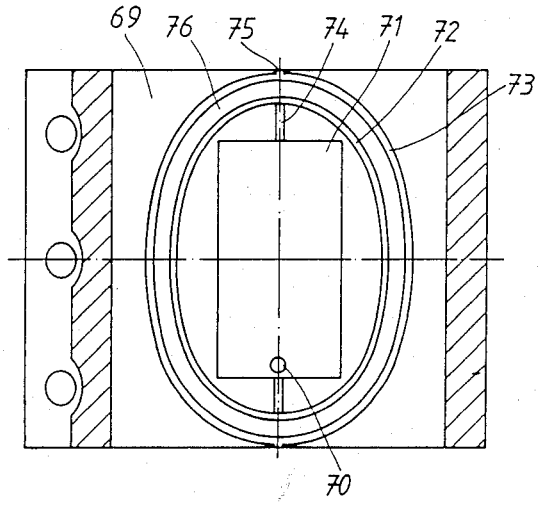
FIG. 5 shows a section through the roller cage on the line A—A in FIG. 4.

The forces between the pistons 35 and the roller cages 40 and the forces between the drive rollers 38 and the roller cages 40 are for the most part hydrostatically balanced. The bearing pressures on the coacting bearing surfaces 37 and 41 on a given piston 35 and its roller cage 40 and between bearing surfaces 69 in that roller cage 40 and the surface of the respective drive roller 38 are small. By means of the bore 36, pressure medium in the cylinder 34 has a free passage through the piston 35 to a space 78 between the piston 35 and the cage 40. In the roller cage 40 there is a channel 70 which allows pressure medium in the space 78 access to the recess 71 in the bearing surface 69 of the roller cage 40. As is best shown in FIGS. 4 and 5, this recess 71 is surrounded by at least one, but suitably two, annular grooves 72 and 73. The groove 72 communicates with the recess 71 through a shallow channel 74. The groove 73 and the groove 75, which is towards the outer side edge of the roller cage, are draining grooves, which discharge pressure medium passing between the drive roller 38 and the annular sealing surface 76 formed between the grooves 72 and 73 in the roller cage 40. The surface area presented by the grooves 72 and 73 is chosen to be of such a size that the desired hydrostatic balancing of the forces, acting on the drive roller 38, and a low surface pressure towards the sealing surface 76 are obtained. In the case of a well-balanced surface pressure, the loss of lubricating pressure medium which passes the sealing surface 76 is small. Further, the drainage groove 73 prevents pressure medium from reaching the outer portions of the roller cage and causing a disturbing deformation thereof. By providing the whole of, or parts of, the area within the inner groove 72 with a recess, a well-defined sealing surface is obtained which is influenced to an insignificant extent by deformations at the central portion of the roller cage 40 due to piston applied forces. Also the diameter of the spherical zone-shaped bearing surface 37 at the outer end of the piston 35, as well as the cooperating bearing surface 41 of the roller cage 40, are chosen with regard to the desired hydrostatic balancing.

Outside the draining groove 73 it may be suitable to provide the side surfaces 69 of the roller cage 40 facing the roller with a recess except at the outer part. The reason for this is that a hydrodynamic lubricating effect between the roller 38 and the roller cage 40 in these areas may have a disturbing influence.

Figure 6:
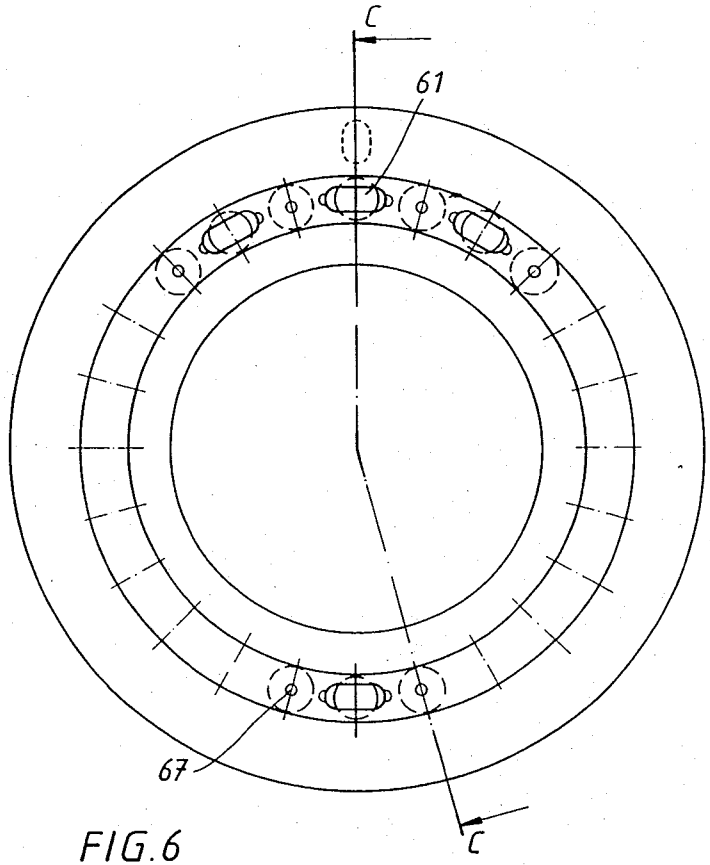
FIG. 6 shows a partial sectional view taken on the line B—B in FIG. 2 of the plane slide used for controlling pressure medium flow to and from the motor.
Figure 7:
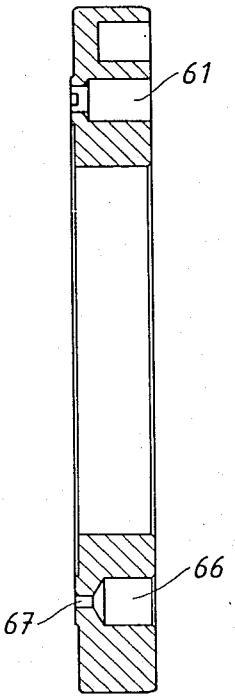
FIG. 7 shows a section on the lines C—C in FIG. 6.

The preferred embodiment of the slide ring 57 is better illustrated in FIGS. 6 and 7. The passage 61 changes shape at the side which slides against the slide ring 56 and has here an elongated, oval shape.

What is claimed is:

1. In a hydraulic radial piston motor which includes a housing; a cam disc which has an internal cam surface; a cylinder block havng a plurality of radially disposed cylinders; a plurality of pistons, a respective piston being slidably disposed in a respective cylinder; a plurality of roller cages, each roller cage being located between a respective piston and the cam disc, and each roller cage including an outer bearing surface which is shaped as part of the internal surface of a cylinder; two guide units fixedly joined to the cylinder block, each guide unit including radially inwardly directed guide slots, the guide slots being in register on opposite sides of each respective roller cage; a plurality of cam-follower rollers, each cam-follower roller being located in a respective roller cage and having an outer surface which rolls against the internal cam surface of the cam disc, each cam-follower roller including a shaft pin at its opposite ends which mount respective guide bearings, the respective guide bearings being movable in the associated guide slots of the guide units and transmitting tangential forces that act on the cam-follower rollers to the guide units and thus to the cylinder block, the improvement wherein each roller cage and associated piston are separate elements which are movable with respect to one another, each roller cage having an inner bearing surface and each piston having an outer bearing surface constructed such that angular motions therebetween are possible in all directions, and each roller cage includes a hydrostatic bearing which cooperates with the outer surface of the associated cam-follower roller.

2. A hydraulic motor according to claim 1, wherein each hydrostatic bearing includes a recess in the central region of the outer bearing surface of each roller cage and a draining groove surrounding said recess, and an annular sealing surface between said recess and said draining groove cooperating with the cam-follower roller.

3. A hydraulic motor according to claim 1, wherein a spring is connected between each piston and its respective roller cage, said spring extending in the bore of each piston.

4. A hydraulic motor according to claim 1, wherein each roller cage with its hydrostatic bearing surrounds the surface of the respective cam-follower roller over more than 180°.

5. A hydraulic motor according to claim 1, wherein the forces acting on each cam-follower roller are hydrostatically counterbalanced in the supporting bearing to at least 80%.

6. A hydraulic motor according to claim 1, wherein each piston of the motor is formed with a through-going axial bore and in which each roller cage is formed with a guide pivot which extends into the bore in the piston, said guide pivot, at least over a part thereof, extending into the bore forming a throttling annular slot restricting the loss of pressure medium between the piston and the roller cage when the roller cage is separated from the piston.

7. A hydraulic motor according to claim 1, wherein said outer bearing surfaces of the pistons and the inner bearing surfaces of the roller cages are part-spherical.

8. A hydraulic motor according to claim 7, wherein each roller cage with its hydrostatic bearing surrounds the surface of the respective cam-follower roller over more than 180°.

9. A hydraulic motor according to claim 7, wherein the forces acting on each cam-follower roller are hydrostatically counterbalanced in the supporting bearing to at least 80%.

10. A hydraulic motor according to claim 1, wherein each piston of the motor is formed with a through-going axial bore and each roller cage is formed with a guide pivot which extends into the bore in the respective piston.

11. A hydraulic motor according to claim 10, wherein each roller cage with its hydrostatic bearing surrounds the surface of the respective cam-follower roller over more than 180°.

12. A hydraulic motor according to claim 10, wherein the forces acting on each cam-follower roller are hydrostatically counterbalanced in the supporting bearing to at least 80%.

13. A hydraulic motor according to claim 1, wherein each roller cage includes a bore which communicates with the bore in the associated piston such that pressure medium can be supplied to the hydrostatic bearing therein.

14. A hydraulic motor according to claim 13, wherein the forces acting on each cam-follower roller are hydrostatically counterbalanced in the supporting bearing to at least 80%.

15. A hydraulic motor according to claim 1, wherein each hydrostatic bearing includes at least one annular groove in the outer bearing surface of each roller cage and with a recess within the groove.

16. A hydraulic motor according to claim 15, wherein the forces acting on each cam-follower roller are hydrostatically counterbalanced in the supporting bearing to at least 80%.

17. A hydraulic motor according to claim 1, wherein each hydrostatic bearing includes a first annular inner groove and a second outer draining groove in the outer bearing surface of each roller cage, an annular sealing surface between said inner and outer grooves cooperating with the cam-follower roller, and a recess within said inner groove.

18. A hydraulic motor according to claim 17, wherein the forces acting on each cam-follower roller are hydrostatically counterbalanced in the supporting bearing to at least 80%.

* * * * *